US006057778A

United States Patent [19]

Davidson

[11] Patent Number: 6,057,778

[45] Date of Patent: May 2, 2000

[54] MODULAR INTERCHANGEBLE COVER SYSTEM

[75] Inventor: Curtis R. Davidson, Oswego, Ill.

[73] Assignee: Pittway Corporation, Chicago, Ill.

[21] Appl. No.: 09/244,194

[22] Filed: Feb. 4, 1999

[51] Int. Cl.[7] ..... G08B 23/00

[52] U.S. Cl. ..... 340/693.5; 340/693.9; 340/693.12; 340/691.1

[58] Field of Search ..... 340/628, 629, 340/630, 540, 541, 693.1, 693.2, 693.4, 693.5, 693.6, 693.7, 693.9, 693.11, 691.1, 321, 326, 331, 332, 384.1, 693.12; 362/86, 171, 172, 173, 186, 253

[56] References Cited

U.S. PATENT DOCUMENTS

| | | | |
|---|---|---|---|
| D. 355,862 | 2/1995 | Tice et al. | D10/106 |
| 1,993,765 | 3/1935 | Waker | 362/253 |
| 3,959,788 | 5/1976 | Tipton et al. | 340/629 |
| 4,090,178 | 5/1978 | Norris | 340/628 |
| 4,214,298 | 7/1980 | Propst et al. | 362/253 |
| 4,315,594 | 2/1982 | Niederost | 340/693.11 |
| 4,489,308 | 12/1984 | Logan, Jr. et al. | 340/628 |
| 4,796,018 | 1/1989 | Nakanishi et al. | 340/691.1 |
| 4,812,827 | 3/1989 | Scripps | 340/628 |
| 4,896,145 | 1/1990 | Lewkowicz | 340/693.1 |
| 5,448,462 | 9/1995 | Moran, III | 362/301 |
| 5,557,262 | 9/1996 | Tice | 340/628 |
| 5,684,467 | 11/1997 | Hur | 340/693.9 |
| 5,726,634 | 3/1998 | Hess et al. | 340/628 |
| 5,914,665 | 6/1999 | Thorp et al. | 340/691.1 |
| 5,969,627 | 10/1999 | Tarlton et al. | 340/693.12 |

OTHER PUBLICATIONS

Wheelock brochure, "Alarm Signals For Industrial Safety And Communication" (10 pages).

American Security Equipment Company brochure FSL1–1–12 & FSL1–1–24 Electronic Sounder/Strobe Combination (2 pages).

American Security Equipment Company "SL–3 Fire Alarm Strobe Light" (2 pages).

Gentex brochure "710CS/710LS Single Station 120 VAC Photoelectric Smoke Detector . . . " (2 pages).

Gentex brochure "GX Series" (2 pages).

FCI brochures, Bulletins S–340/0481, S–300/0182 and S–341/0487 (3 pages).

System Sensor brochure "Installation Instructions For Models: MA–12/241 Electronic Sounder, SS–12, SS–24 Electronic Strobe, MA/SS–121, MA/SS–241 Sounder/Strobe Combined" (4 pages) 1990.

*Primary Examiner*—Jeffery A. Hofsass
*Assistant Examiner*—Van T. Trieu
*Attorney, Agent, or Firm*—Rockey, Milnamow & Katz, Ltd.

[57] ABSTRACT

A family of covers having identical indented base regions for receiving a plurality of diverse alarm indicating and/or condition-sensing modules thereon. The alarm indicating modules each have a common "footprint" for being snugly received into the indented base region of each cover. A family of covered modules thus assembled, achieves an architecturally pleasing, universal design, and reduces tool and manufacturing costs by producing common parts among the varied alarm indicating devices.

16 Claims, 13 Drawing Sheets

46
41
41a
57
55
57
86
42
40a
42a
40
43
43a
48
61
54
56
80
51
30
52
60
D
62
53
63
71a
5
29
39
70a
72a
4
4
5
108
38
84
73a
35
33
21
28
34
23
22
36

MODULAR INTERCHANGEBLE COVER SYSTEM

TECHNICAL FIELD OF THE INVENTION

The present invention relates to alarm-indicating and/or condition-sensing devices and systems of such devices. Particularly, the invention relates to a family of covers for different types of alarm-indicating and/or condition-sensing devices such as detectors, alarms, loudspeakers and the like.

BACKGROUND OF THE INVENTION

Alarm-indicating or condition-sensing devices are used in residences and buildings to sense emergency conditions and/or to signal occupants of an emergency condition, or to provide emergency communication to occupants. The alarm indicating devices can include smoke detectors, fire alarms, carbon monoxide detectors and alarms, burglar alarms, and other emergency detectors and/or alarms. The alarm-indicating devices can include loudspeakers, strobe lights and horns.

A system of alarm-indicating devices and/or condition-sensing devices can include different types of devices. The devices of the system can be separately operated or can be part of an integrated, centrally controlled system.

The known type of alarm-indicating devices or condition-sensing devices include plastic covers which mount to base plates. The base plates are fastened to a wall or ceiling structure. Each cover is sized and fashioned particularly for the device. A smoke detector cover is disclosed for example in U.S. Pat. No. Des. 355,862. Also known are alarm modules which attach to junction boxes, the junction boxes attached to the structure of the building.

The present invention recognizes that it would be desirable to provide a uniform cover for covering a surface mounted junction box, which cover would accept a plurality of types of alarm-indicating and/or condition-sensing modules. The present invention recognizes that it would be desirable to provide a universal cover which accepts a plurality of alarm-indicating and/or condition-sensing modules in a substantially flush manner. The present invention recognizes that when a plurality of covers are installed in a residence or building, a uniformity of cover styles would be desirable.

SUMMARY OF THE INVENTION

The present invention contemplates an alarm indicating and/or condition-sensing system which includes a plurality of alarm units or covered modules each having a cover of a common style.

A family of covers is provided, each having an identical indented base region for receiving one of a plurality of diverse alarm-indicating and/or condition-sensing modules. The alarm-indicating and/or condition-sensing modules each have a common "footprint" for being snuggly received into the indented base region of each cover. A family of covered modules thus assembled, achieves an architecturally pleasing, universal design, and reduces tool and manufacturing costs by producing common parts among the diverse alarm devices.

The covers each include a peripheral skirt adapted to be positioned adjacent to a selected surface at which the respective cover is mountable. The peripheral skirts depend from front walls which each exhibit at least one common base-defining dimensional parameter.

The covers can include an alarm signal-receiving region or a condition-sensing region at least partially bounded by or at least partially enclosed by the peripheral skirt. In some cases they can also include an alarm signal output port from which an alarm signal can radiate. The alarm signal can be communicated to a central control or can radiate into an adjacent exterior region through the peripheral skirt.

A plurality of alarm-indicating and/or condition-sensing modules, wherein at least two of the modules are different members of the group which includes an audible alarm, a visible alarm, and a combined audible/visible alarm, are each combinable with respective ones of the covers to thereby form a plurality of covered modules. Each of the covered modules exhibits the at least one common base-defining dimensional parameter.

The covers can be removably coupled to mounting fixtures, such as to surface-mounted junction boxes. The alarm-indicating and/or condition-sensing modules can be removably coupled to the respective covers. Advantageously, the alarm-indicating and/or condition-sensing modules can extend through the covers and extend, at least in part, into the mounting fixtures.

The peripheral skirt depends from a circular front wall having a recessed base for receiving an alarm-indicating and/or condition-sensing module. The common base-defining dimensional parameter can correspond to a common diameter of the recessed base. Each respective cover can exhibit a convex shape when positioned adjacent to the selected surface. The cover can enclose the mounting fixture and fit flushly against the mounting surface.

The covers of the invention advantageously are each circular in front profile and each have a circular recessed base region. The alarm-indicating and/or condition-sensing modules each have an identical circular footprint which can be snuggly received within the circular recessed based region of an associated cover.

Each cover can be fastened to an electrical box, such as a 4" by 4" electrical junction box, by an overlying adaptor plate and a plurality of fasteners. The adaptor plate provides plural fastener-receiving barrels aligned with fastener holes provided through an associated alarm-indicating module. Fasteners which are inserted into the fastener holes of the alarm-indicating and/or condition-sensing module engage the fastener-receiving barrels to hold the alarm-indicating and/or condition-sensing module to the adaptor plate, and hence to the associated cover.

According to one aspect of the invention the covers and the adaptor plates are of a universal design for varied alarm-indicating and/or condition-sensing modules. According to an alternate aspect of the invention, the cover can be of a universal design and the adaptor plate can be varied having special arrangements for different requirements such as the number or location of fastener receiving barrels. These provisions reduce tooling and manufacturing costs by producing common parts among the varied alarm devices.

By the provision of the varied adaptor plates, the alarm-indicating and/or condition-sensing modules can be associated with a particular adaptor plate for installation to the universal cover. Any alarm-indicating and/or condition-sensing module of the family of alarm-indicating modules described herein, can be mounted to any universal cover throughout a facility to maintain an architecturally pleasing, universal design.

The invention contemplates a monitoring system which includes a plurality of ambient condition detectors. A common control element can be in communication with the members of the plurality.

A plurality of alarm-indicating output devices or covered modules is in communication with the control element. The different members of the plurality of alarm-indicating output devices include an audible alarm, a visible alarm, and a combines audible/visible alarm.

The alarm-indicating output devices include a plurality of covers. Each of the covers has a peripheral skirt adapted to be positioned adjacent to a selected surface at which the respective cover is mountable. The peripheral skirts depend from a front wall which each exhibit at least one common base-defining dimensional parameter.

The covers each define an alarm signal receiving region at least partially bounded by the peripheral skirt. The covers can each define an alarm signal output port. An alarm signal in the respective receiving region can exit the cover through the output port and radiate into an adjacent exterior region. The system can include a communications link, such as a cable, coupled between the control element and the output device.

Numerous other advantages and features of the present invention will become readily apparent from the following detailed description of the invention and the embodiments thereof, from the claims and from the accompanying drawings.

DETAILED DESCRIPTION OF THE PREFERRED EMBODIMENTS

Figure 1:
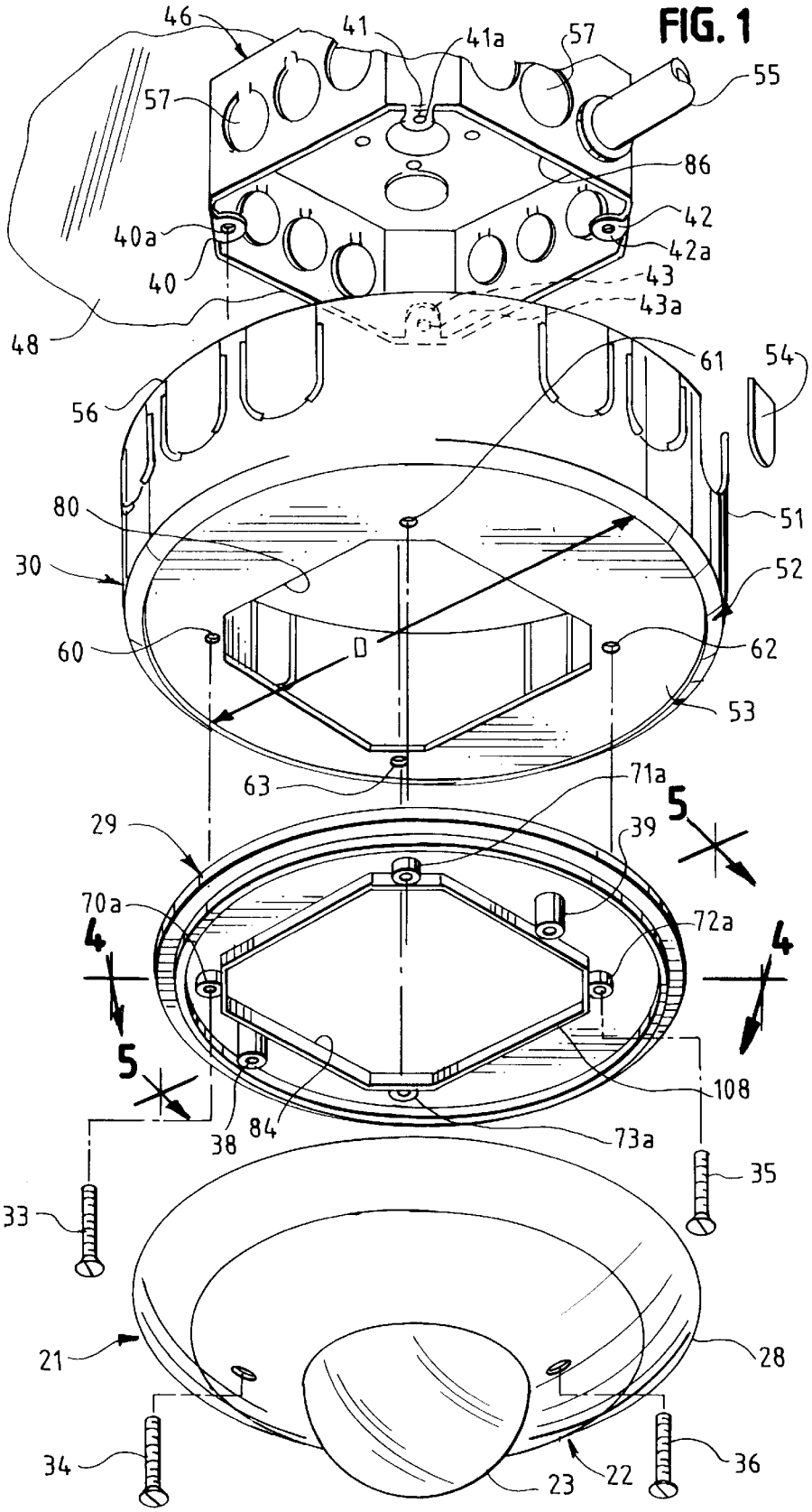
FIG. 1 is an exploded perspective view of a covered module of the present invention.

While this invention is susceptible of embodiment in many different forms, there are shown in the drawings and will be described herein in detail specific embodiments thereof with the understanding that the present disclosure is to be considered as an exemplification of the principles of the invention and is not intended to limit the invention to the specific embodiments illustrated.

FIG. 1 illustrates an alarm unit or covered module 20 of the present invention. The alarm unit 20 includes an alarm-indicating and/or condition-sensing module 21, which in the illustrated embodiment is a strobe light module 22. The module 22 includes a strobe light 23 centrally located on an alarm module wall 28. The alarm module wall 28 is held onto an adaptor plate 29 by two screws 34, 36 which are held by two screw-receiving barrels 38, 39.

The adaptor plate 29 is held against a cover 30 by two screws 33, 35 which thread into at least two of four screw holes 40*a*, 41*a*, 42*a*, 43*a* of respective screw receiving tabs 40, 41, 42, 43 of a back box 46. The back box 46 is preferably in the form of a 4"×4" electrical junction box. The back box 46 is typically mounted to a wall or a ceiling surface 48. The cover 30 includes a skirt 51 depending from a front wall 52. The front wall 52 includes a recessed base region 53 which is defined by a base-defining dimensional parameter D of a lip 53*a*. The skirt includes removable panels 54 which allows penetration of a conduit 55 into the back box 46 when the cover 30 is placed over the back box 46 with an edge 56 placed against the wall or ceiling surface 48. The conduit 55 carries wires or other transmission means for communicating power and/or signals into or out of the back box. The back box 46 includes punch-out panels 57 for accepting one or more conduits 55.

The base region 53 includes four screw through-holes 60, 61, 62, 63 which are in registry with at least the screw-engaging holes 40*a*, 41*a*, 42*a*, 43*a* of the tabs 40, 41, 42, 43 respectively. The through-holes are also in registry with four holes 20*a*, 21*a*, 22*a*, 23*a* of the adapter plate 29. At least two screws 33, 35 hold the adapter plate 29 and the cover 30 onto the box 46 and against the surface 48. Preferably, the two screws 33, 35 are engaged to opposing corner holes located diagonally across the back box, such as the screw engaging holes 40*a*, 42*a*. The cover includes a substantially rectangular opening 80 through the base region 53. The adaptor plate includes a substantially rectangular opening 84 which is in registry with the opening 80. Both the openings 80, 84 are substantially in registry with an open face 86 of the back box 46. The opening 80 and/or the opening 84 allow radiation or transmission of an alarm signal from within the cover 30 to the alarm module 21 mounted thereon, i.e., the openings 80 and/or 84 act as a "signal port."

The cover 30, the adaptor plate 29, and the module wall 28 and all preferably composed of plastic.

Figure 2:
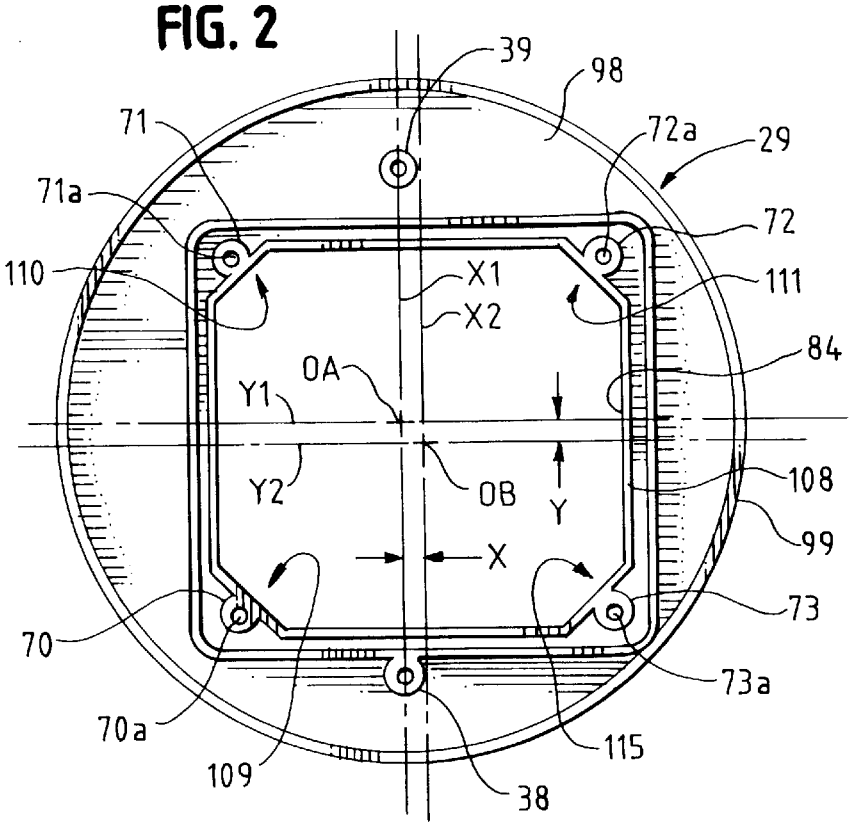
FIG. 2 is a front side view of an adaptor plate shown in FIG. 1.
Figure 3:
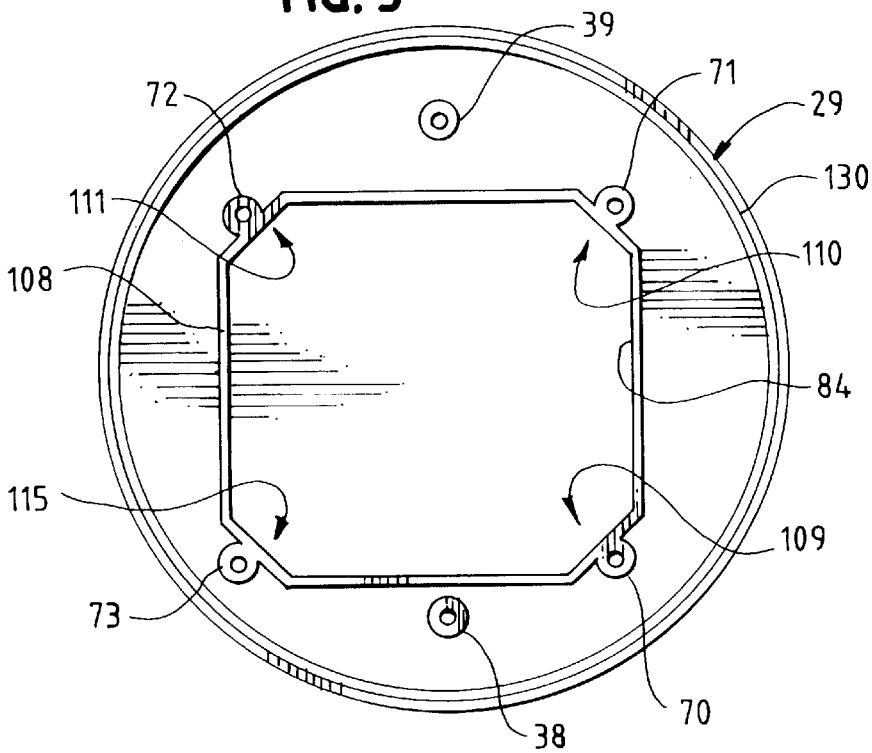
FIG. 3 is a rear view of the adaptor plate shown in FIG. 2.

FIGS. 2–3 illustrate the structure of the adaptor plate 29. The adaptor plate 29 includes a circular plate body 98 having a turned edge 99. The screw-receiving barrels 38, 39 extend through the plate body 98 and are formed therewith. The plate body 98 includes the substantially square aperture 84 which is in substantial registry with the open face 86 of the back box 46. The screw-engaging holes 40*a*, 41*a*, 42*a*, 43*a* are in registry with mounting holes 70*a*, 71*a*, 72*a*, 73*a* of the plate body 98. The holes 70*a*, 71*a*, 72*a*, 73*a* are bounded by corresponding circular walls 70, 71, 72, 73. The circular walls are continuous with a substantially square wall 108 having flat corners 109, 110, 111, 112.

The circular plate body 98 has a center point OA, and reference center lines X1, Y1. The square aperture 84, the holes 70*a,* 71*a,* 72*a,* 73*a* and the square wall 108 have a center point OB and reference center lines X2, Y2. The center point OB is offset from the center point OA by the distances X, Y between the center lines X1, X2 and Y1, Y2 respectively. Thus, the cover 30 and adapter plate 29 are mounted eccentrically to the back box. An alarm module 21 mounted to the adapter plate will enter into the back box closer to one side than the opposing side along one or both axes X2, Y2. The eccentricity is advantageous in arranging the electronic components on the alarm module 22, which may be more effectively arranged eccentrically to the center line of the strobe light 23, while maintaining the strobe light 23, or other indicating device, centered on the module wall 28. This eccentricity may also be advantageous to allow more room inside the back box to make connections or to secure the conduit to one side of the box by a conduit nut.

Although FIGS. 1 through 3 illustrate an adaptor plate having two screw-receiving barrels 30, 39, more or fewer screw-receiving barrels can be used depending on the attachment arrangement of the associated alarm indicating module.

Figure 4:
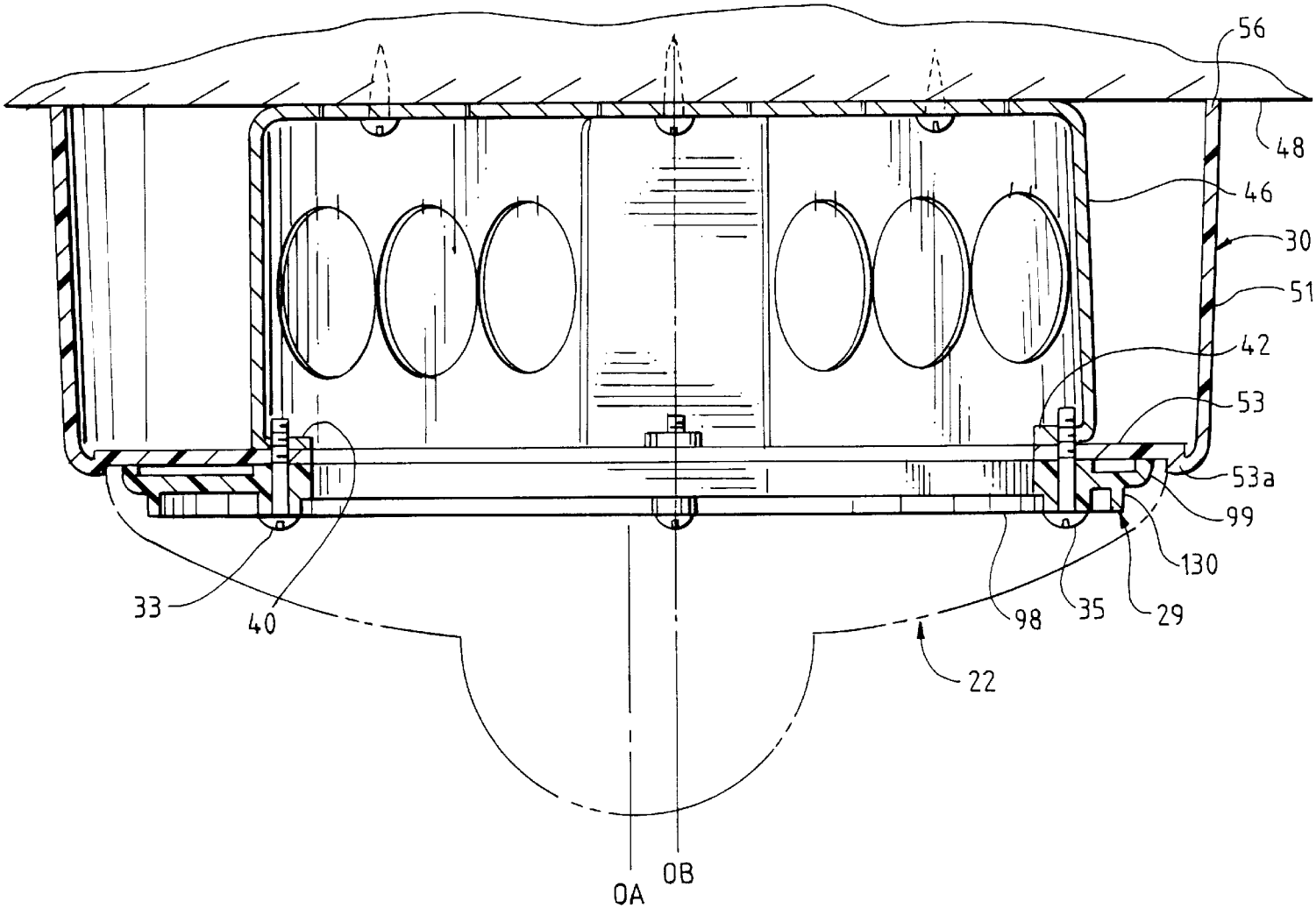
FIG. 4 is a sectional view of the installed covered module of FIG. 1 taken generally along line 4—4 from FIG. 1, with an alarm module shown in phantom.
Figure 5:
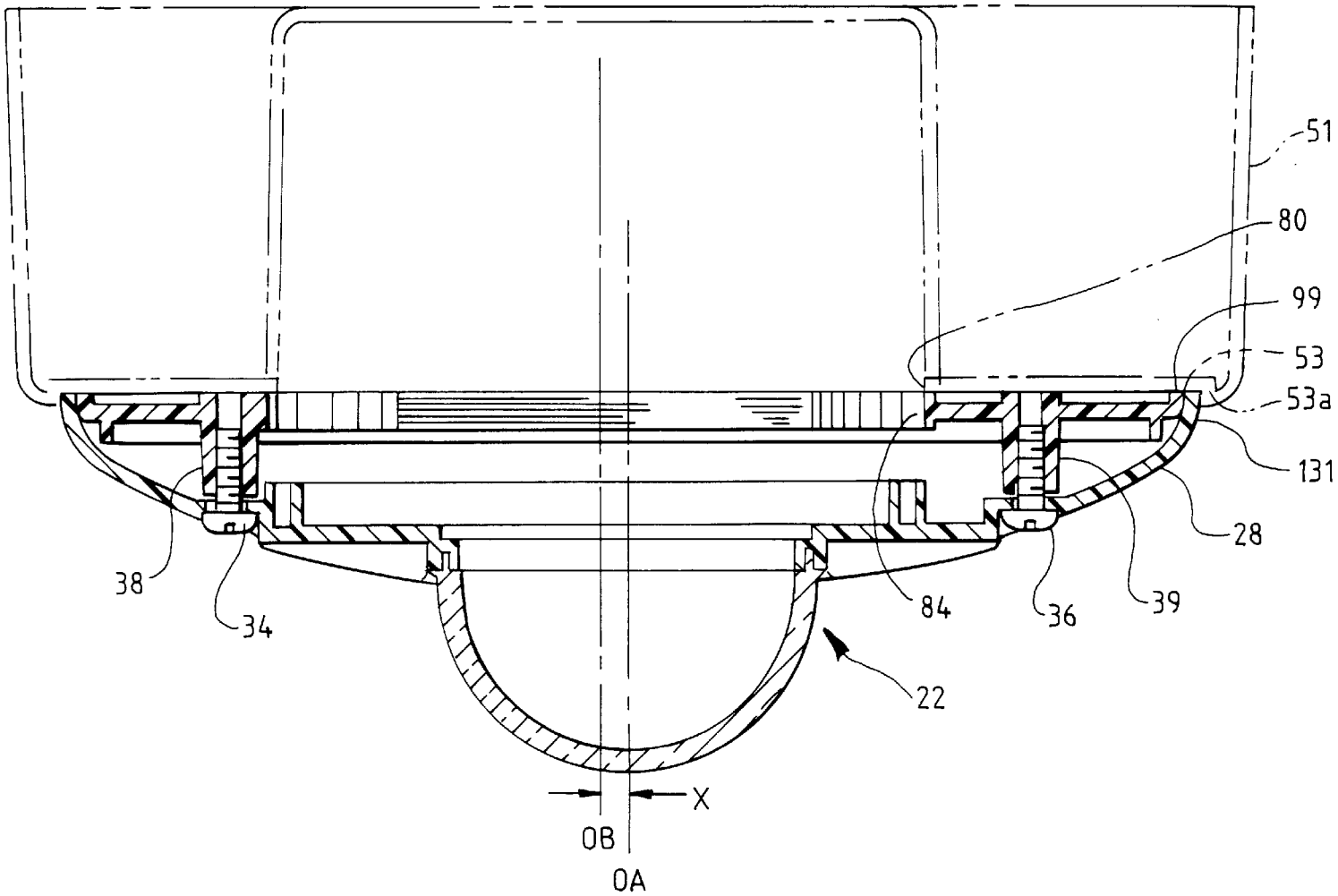
FIG. 5 is a sectional view of the installed covered module of FIG. 1, taken generally along line 5—5 from FIG. 1, with a cover and a junction box shown in phantom.

FIGS. 4 and 5 illustrate the adaptor plate 29 includes an annular reinforcing wall 130 extending substantially perpendicularly from the plate body 98 in an opposite direction as the turned edge 99. Additionally, FIG. 5 illustrates that the alarm module wall 28 includes a rearwardly directed edge 131 that tightly fits between the turned edge 99 of the adaptor plate 29 and the lip 53*a* of the base region 53. This tight fit around the edge 131 ensures a completely tight and integrated covered module once assembled.

Figure 6:
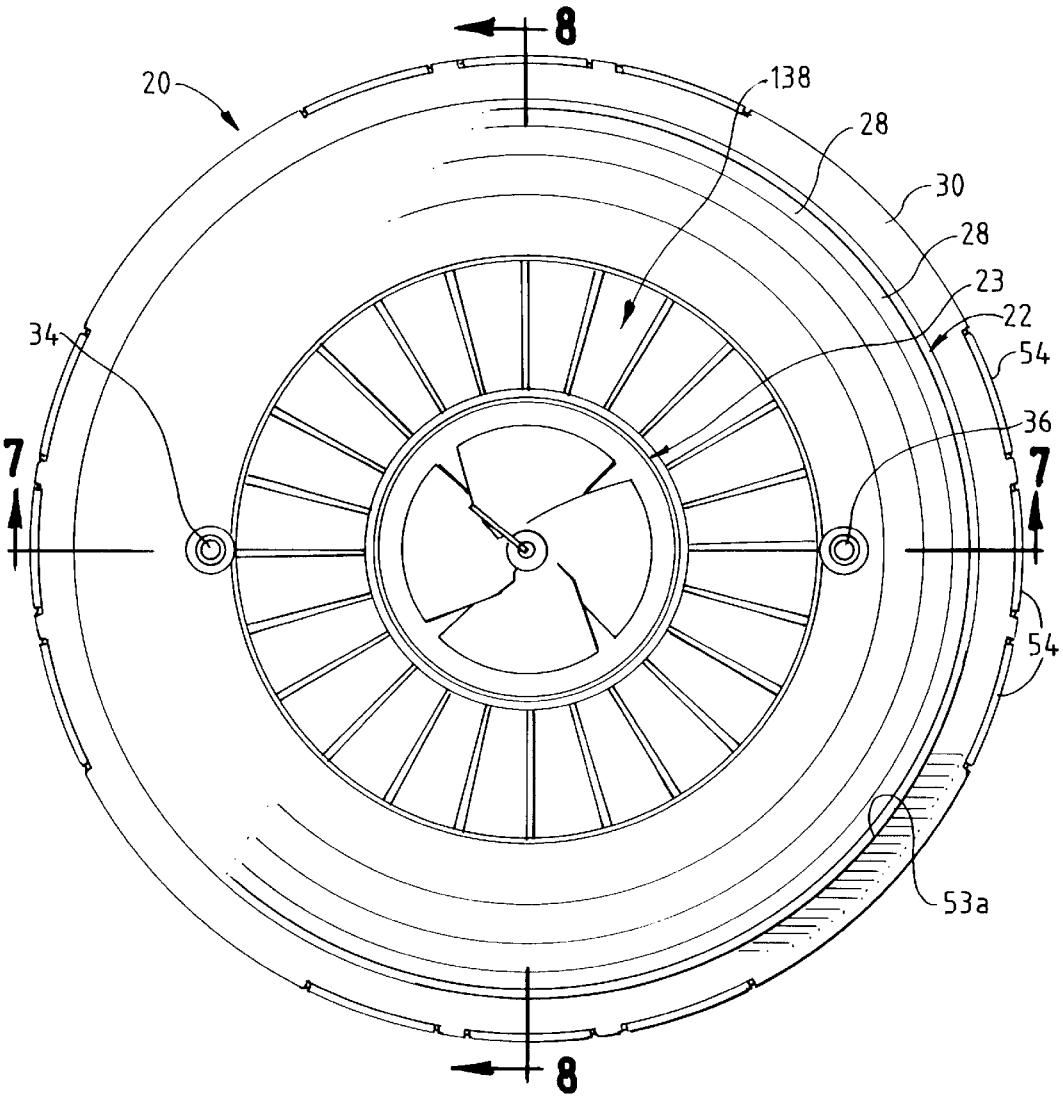
FIG. 6 is a plan view of a strobe alarm unit in accordance with the invention.

FIG. 6 illustrates that the alarm module wall 28 includes a contoured region 138 surrounding the strobe light 23 which adds visual effect and reflecting advantages to the strobe light when operating. The module wall 28 fits tightly within the lip 53*a* of the base region 53. Screws 34, 36 retain the alarm module 22 onto the cover 30.

Figure 7:
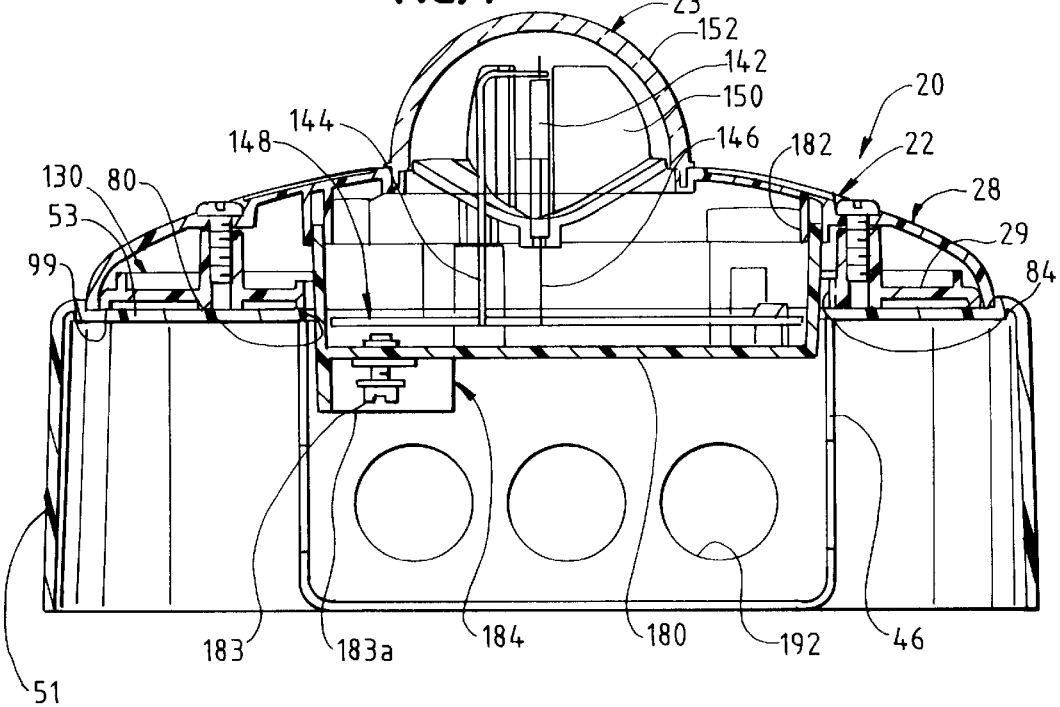
FIG. 7 is a sectional view taken generally along line 7—7 of FIG. 6.
Figure 8:
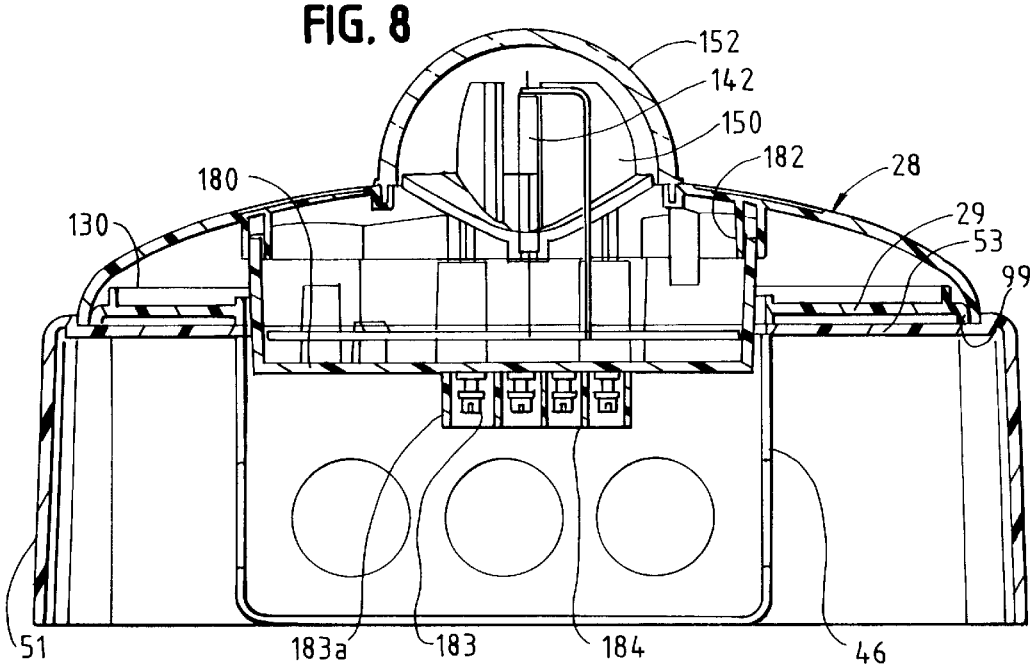
FIG. 8 is a sectional view taken generally along line 8—8 of FIG. 6.

FIGS. 7 and 8 illustrate the strobe alarm module 22 to include a strobe bulb 142 electrically connected by conductors 144, 146 to a printed circuit board 148. The bulb 142 is located within a reflector 150 and beneath a lens 152.

Figure 11:
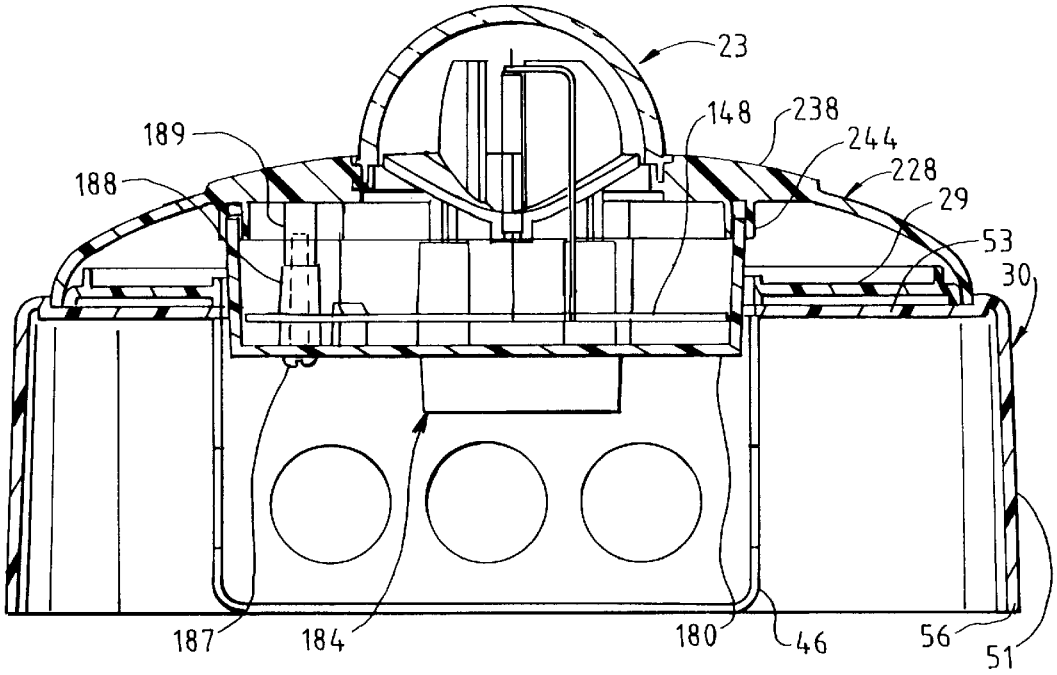
FIG. 11 is a sectional view taken generally along line 11—11 of FIG. 9.

The printed circuit board 148 and a back side of the strobe module 22 and associated electronic components are enclosed by a box-like base member 180 which can snap-engage into a channel 182 formed on a back side of the module wall 28. Alternatively, the base member 180 can be attached by two screws 187 which are each received into a guiding cylinder 188 of the base member 180 and which are each threadedly engaged by a screw receiving barrel 189 of the module wall 28 or 228 as shown in FIG. 11. The screw, cylinder and barrel assemblies 187, 188, 189 are located at diagonally opposite corners of the base member 180 (not shown). The base member is preferably composed of plastic. Rearwardly directed wire-screw terminals 183 provide conductors through the base member 180 and electrical terminations on an outside of the base member 180 within the box 46. The terminals 183 are surrounded on three sides by walls, 183*a*. Preferably, four terminals 183 are provided in a row, configured in an integral terminal block 184. The module wall 28 including the strobe, electronics and the base member can be removed as a substantially enclosed, protected module for replacement or reinstallation.

The back box 46, typically in the form of a standard 4"×4" electrical junction box, is located within the cover 30. The back box 46 includes the punch-out panels 57 covering holes 192 for the admission of conduits carrying wires for connecting the printed circuit board to a central control or monitoring element, or for delivering power to the alarm module 22. The apertures 80, 84, 86 being aligned, allows for the base member 180 and some components held therein to partially enter the back box 46.

Figure 9:
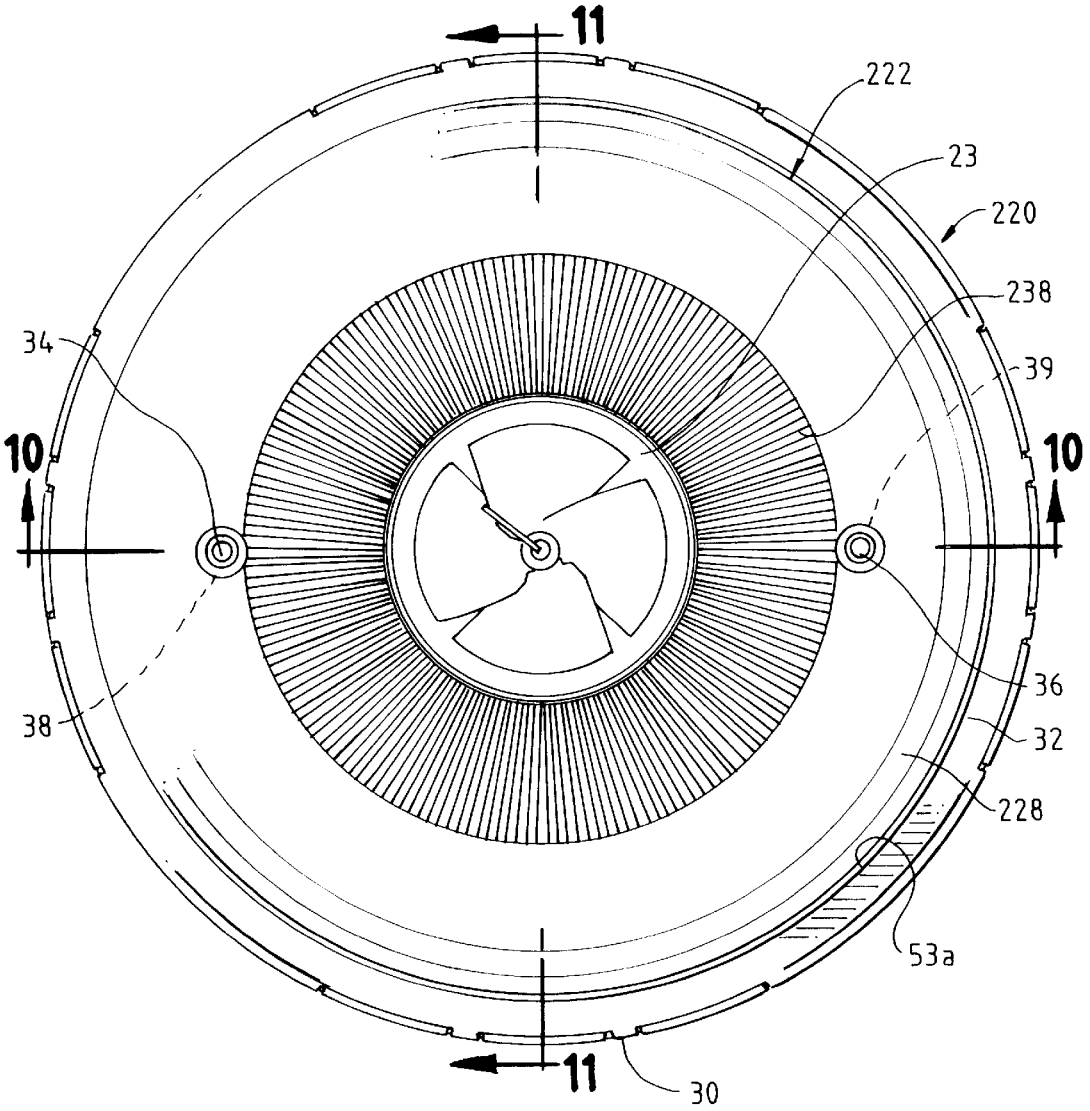
FIG. 9 is a plan view of a horn/strobe alarm unit in accordance with the invention.

FIG. 9 illustrates a further covered module 220 of the invention. A horn/strobe alarm unit 222 includes a centrally located strobe light 23 on a module wall 228. The module wall 228 includes a finned region 238 surrounding the strobe light 23, which assists in radiating a horn signal and reflecting the emitted strobe light. The module wall 228 is fastened onto the cover 30 in an identical fashion to that described in FIG. 1.

Figure 10:
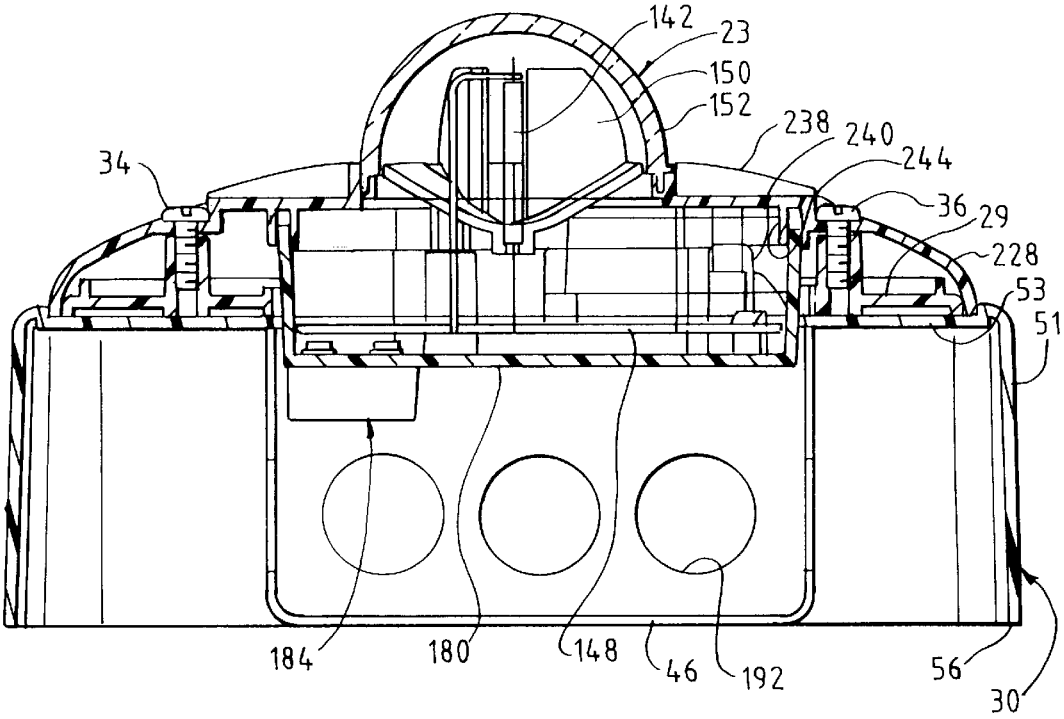
FIG. 10 is a sectional view taken generally along line 10—10 of FIG. 9.

FIGS. 10 and 11 illustrate a horn 240 located beneath the module wall 228. The horn is mounted above the printed circuit board 148. The base member 180 encloses the strobe light 23, the associated electronics, and the horn 240. The module wall 228 includes a channel 244 on its bottom side which engages the base member 180. The base member is attached at diagonally opposite corners by two assemblies (one shown) of the screw 187, the guiding cylinder 188 formed a part of the base member 180, and the screw-receiving barrel 189 formed as part of the module wall 228. The module wall 228 including the strobe, the horn, the electronics and the base member can be removed as a substantially enclosed, protected module for replacement or reinstallation. The base member 180 and the components held therein partially enter the back box 46. The terminal block 184 is shown schematically but could be fashioned as shown in FIGS. 7 and 8.

Figure 12:
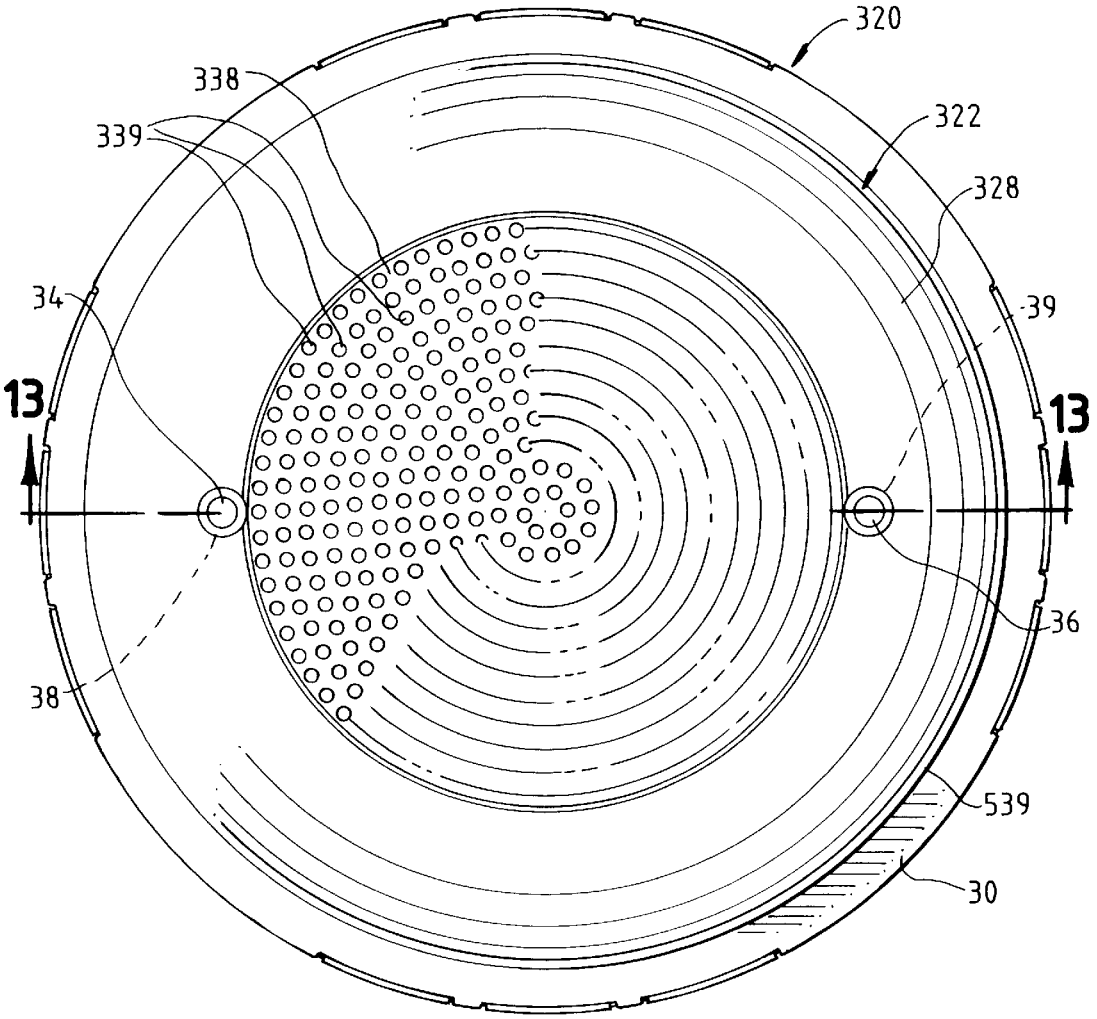
FIG. 12 is a plan view of a loudspeaker alarm unit in accordance with the invention.

FIG. 12 illustrates a further embodiment of the invention. In this embodiment, a covered module 320 includes a speaker module 322. The speaker module 322 includes a grille region 338 centrally located on a module wall 328. The grille region 338 is formed by a plurality of holes 339 through the module wall 328, throughout the grille region. The module wall 328 can be mounted onto the cover 30 in identical fashion to the previous described cover of FIGS. 1–11. The adaptor plate 29 and the back box 46 can also be identical to the previously described embodiments.

Figure 13:
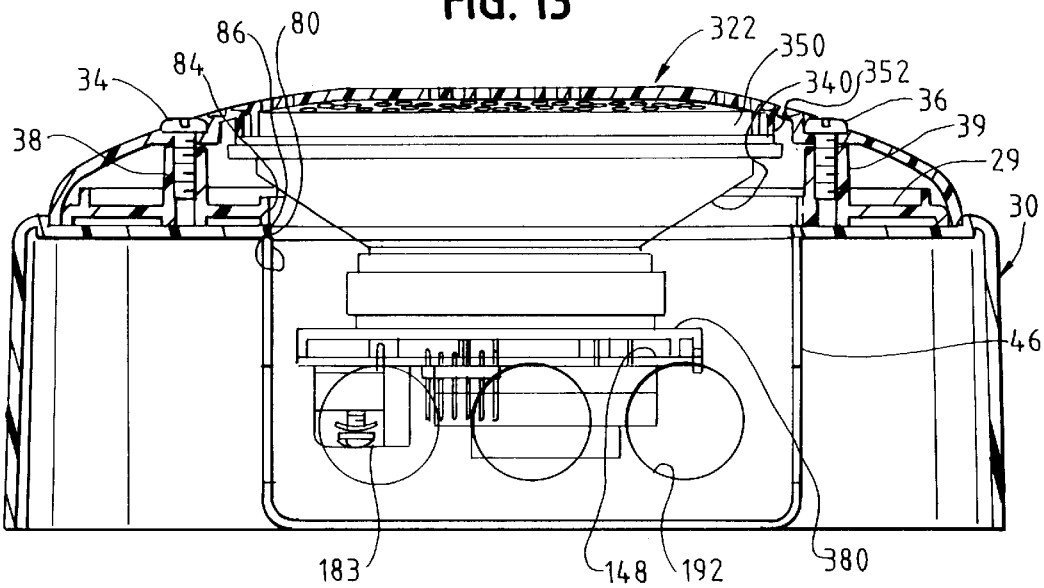
FIG. 13 is a sectional view taken generally along line 13—13 of FIG. 12.

As illustrated in FIG. 13, a loudspeaker 340 is mounted onto the module wall 328 which is mounted to the adaptor plate 29. A front surface 350 of the loudspeaker 340 is pressed to a channel 352 formed on a bottom side of the module wall 328. The loudspeaker 340 is held to the channel 352 as described below with respect to FIGS. 16 and 17.

The loudspeaker 340 includes a mounting bracket 380 which supports the printed circuit board 148 and other associated electronic components. Because of the apertures 80, 84, 86 are in registry, the loudspeaker can at least partially enter the back box 46. The electronic components are contained within the back box 46.

Figure 14:
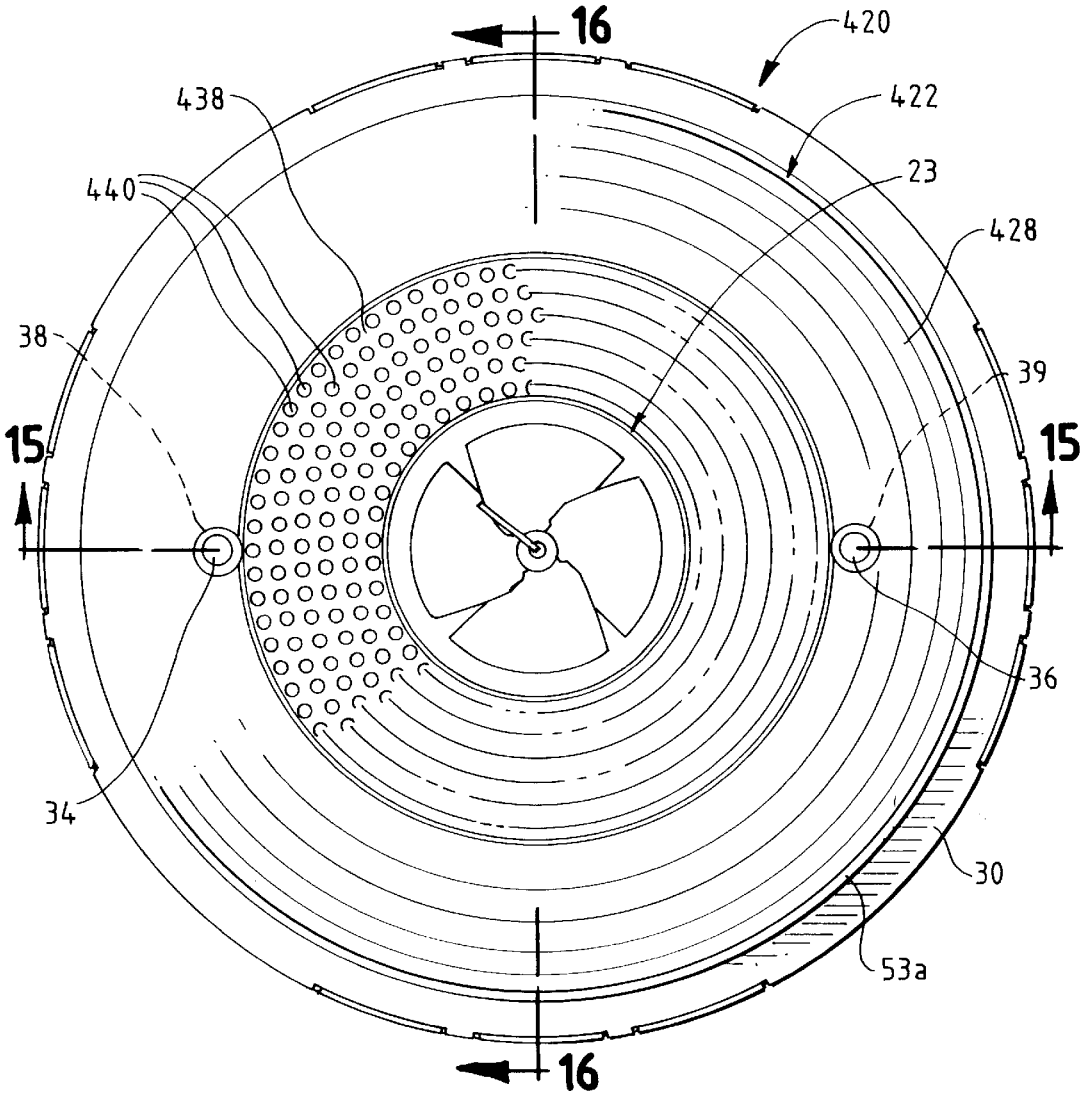
FIG. 14 is a plan view of a loudspeaker/strobe alarm unit in accordance with the present invention.

FIG. 14 illustrates a further embodiment of the invention. A covered module 420 includes a loudspeaker/strobe module 422 mounted to the cover 30. The module 422 includes a strobe light 23 in a central area of a module wall 428. A grille region 438 surrounds the strobe light 23. The grille region 438 is formed by a plurality of holes 440 through the module wall 428, throughout the grille region.

Figure 15:
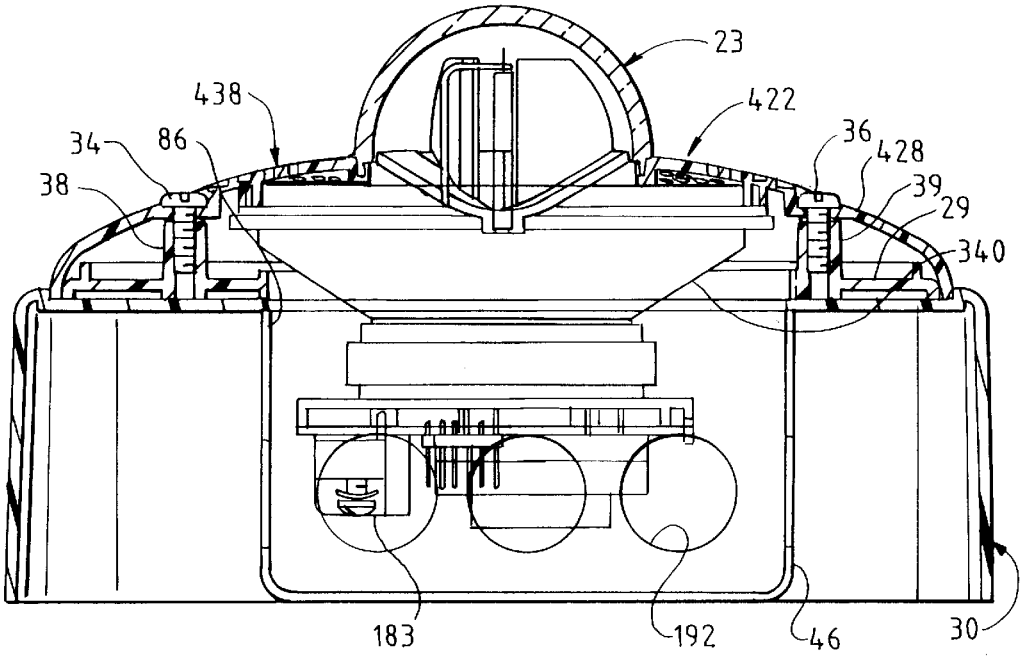
FIG. 15 is a sectional view taken generally along line 15—15 of FIG. 14.

As illustrated in FIG. 15, a loudspeaker 340 is mounted to the module wall 428 and the adaptor plate 29 as described per FIG. 13. The strobe light 23 includes identical elements as shown in FIG. 7. Sound from the loudspeaker 340 radiates through the grille 438.

Similar to the embodiment of FIG. 13, the loudspeaker/strobe module 422 includes components which are contained within the back box 46. The speaker 340 partially enters the back box 46.

Figure 16:
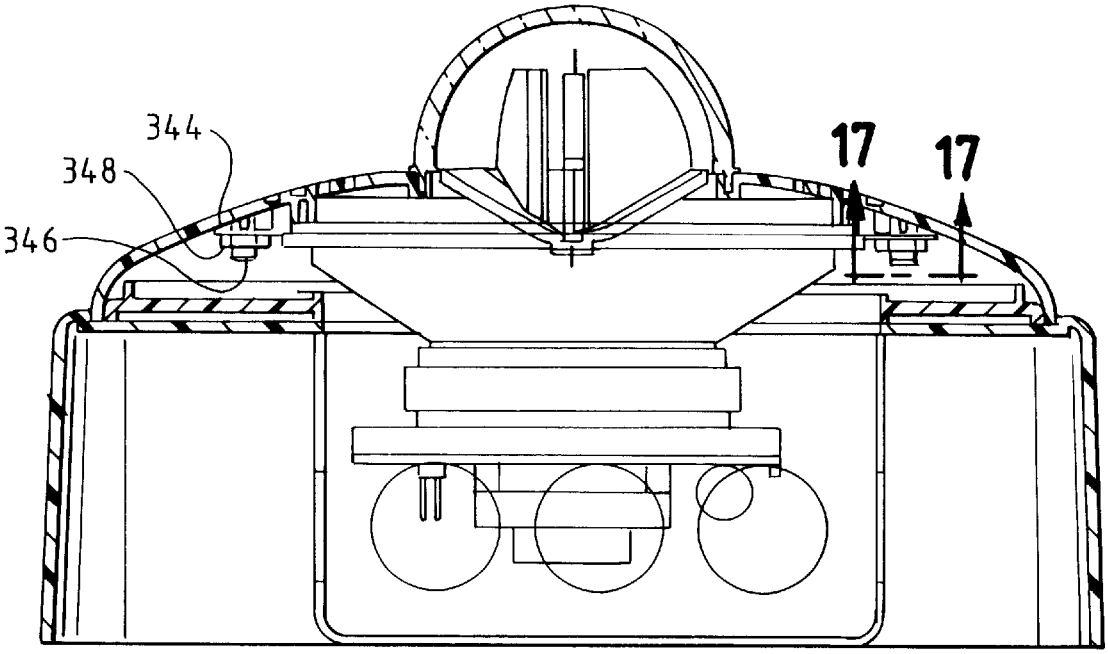
FIG. 16 is a sectional view taken generally along line 16—16 of FIG. 14.
Figure 17:
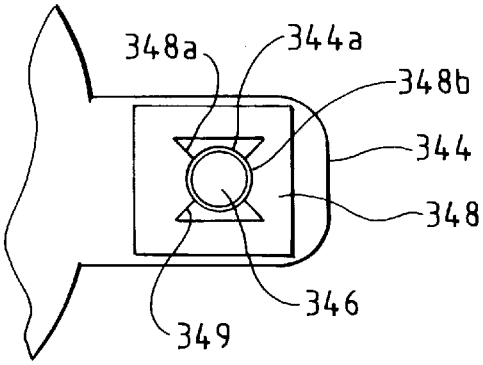
FIG. 17 is a view taken generally along line 17—17 of FIG. 16.

FIGS. 16 and 17 illustrates the manner in which the loudspeaker 340 of either of the embodiments of FIGS. 12 or 14 can be mounted. The loudspeaker 340 includes thin flange tabs 344 which extend radially outwardly and each of which includes an aperture 344*a*. A post 346 is formed on the inside of the module wall 428 at each tab 344. One post enters the apertures 344*a* at each tab 344 and a "Tinnerman" clip 348 having an opening 349 is pressed onto, and locked onto, each post 346. The clip 348 can have bent prongs 348*a*, 348*b* which allow pressing-on in one direction but which grip the post to prevent removal in an opposite direction. Although two posts 346 and two corresponding flange tabs 344 are shown, more could be used such as four posts 346 and four corresponding tabs 344 spaced around the circumference of the loudspeaker 340. Alternately, another type fastener, such as a threaded post and corresponding nut, can be used to secure the loudspeaker 340 to the module wall 428.

An advantage of the present invention is that an identical cover 30, adaptor 29 and back box 46 can be used for each type of covered module 20, 220, 320, 420. The module walls 28, 228, 328, 428 for the various alarm modules are all sized to fit within the lip 53*a* of the cover 30. The covers all have screw holes which are aligned with the screw-receiving barrels of the adaptor plate 29. Each alarm module includes elements which extend downwardly into the back box. Each alarm module has a common "footprint" which corresponds to a dimensional parameter of the cover. The preferred embodiment alarm modules are circular, having a footprint with a common diameter to nest into the base region 53 of each cover 30.

Alternatively, by provision of the adaptor plate 29, the cover 30 can be made universal while the adaptor plate can be configured differently, for accommodating alarm-indicating modules having different fastening locations or requirements. Thus tooling and material savings can be achieved by separating the cover 30 and their covering function from the adaptor plates 29 and their mounting function and providing a universal cover 30 and varying adaptor plates 29.

Advantageously, the covers 30, the adaptor plate 29 the module walls 28, 228, 328, 428 and the base members 180 are all composed of plastic.

Figure 18:
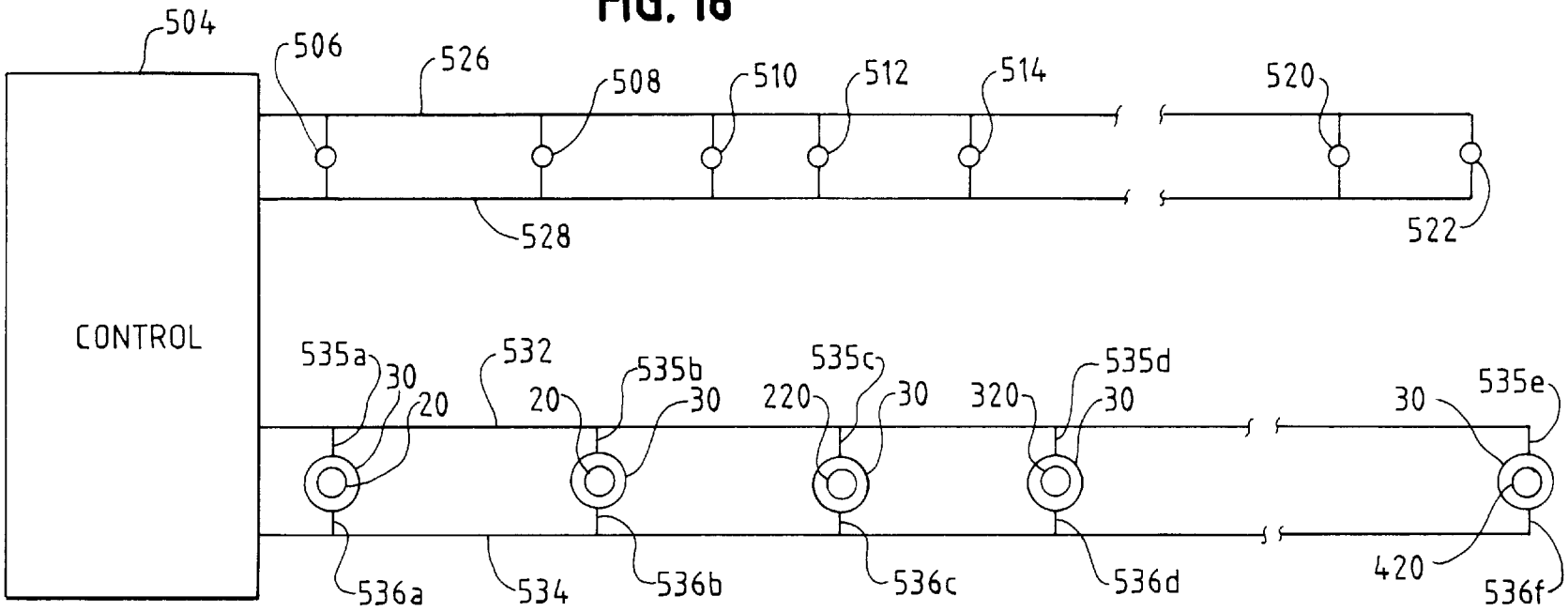
FIG. 18 is a schematic system diagram of a plurality of condition sensors and a plurality of covered alarm modules, all connected to a central control.

FIG. 18 illustrates an alarm system 500 for a facility such as a building. The system 500 includes a control unit 504 which incorporates a computer or a control console in a central location.

A plurality of condition sensors 506, 508, 510, 512, 514, 520, 522 can be connected to detector electrical communication lines 526, 558. The sensors can be of one type, such as smoke detectors, or can be a plurality of different detectors, such as smoke detectors, motion sensors, etc. The sensors are advantageously spaced apart around an inside of the facility.

A plurality of alarm units or covered modules 20, 220, 320, 420 are connected to the control unit 504 via two alarm electrical bus lines 532, 534 and branch wires 535*a–e*, 536*a–e*. The alarm units can be a single type of unit 20, 220, 320, 420, or can be a mixed assortment of the unit types 20, 220, 320, and/or 420 or can include other types as well. The bus lines 532, 534 and branch lines 535*a–e*, 536*a–e* are carried in conduits which terminate in junction boxes 46, as shown for example in FIG. 1. A plurality of the alarm units 20, 220, 320, 420 can incorporate covers 30 to architecturally integrate the alarm system into the facility and provide the other advantages enumerated above. The alarm units are advantageously spaced apart around the facility.

The control unit 504 can transmit an alarm signal to all alarms on the bus lines 532, 534, or the bus lines can be configured so that the control unit 504 can trigger selected alarms.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. A modular alarm-indicating and/or condition-sensing system comprising:

a plurality of covers wherein each of the covers has a front wall and a peripheral skirt adapted to be positioned adjacent to a selected surface at which the respective cover is mountable wherein the front wall of each of the covers exhibits at least one common base-defining dimensional parameter defining an indented base region, wherein each of the covers defines an alarm signal-receiving region at least partially bounded by the peripheral base region and wherein each of the covers defines an alarm signal output port from which an alarm signal in the respective receiving region exits the cover and radiates into an adjacent exterior region;

a plurality of alarm signal-indicating modules wherein at least two of the modules are different members of a group which includes an audible alarm generator, a visible alarm generator and a combined audible/visible alarm generator and are combinable with respective ones of the covers, each module mounted at least partially into one said indented base region of a respective cover to thereby form a plurality of covered modules each of which exhibits the at least one common base-defining dimensional parameter and;

wherein respective ones of the covered modules are removably coupled to an electrical box and wherein respective ones of the alarm signal-indicating modules extend, at least in part, into the electrical box.

2. A system as in claim 1, wherein the covers are removably coupled to respective generating modules.

3. A system as in claim 1, wherein the base regions are circular and wherein the common base-defining dimensional parameter corresponds to a common diameter of said base regions.

4. A system as in claim 1, wherein the covers exhibit a convex shape, when positioned adjacent to the selected surface.

5. A system as in claim 4, wherein the base regions are circular and have a common diameter.

6. A monitoring system comprising:

a plurality of ambient condition detectors;

a plurality of alarm-indicating output devices wherein the output devices include all members of a group including a loudspeaker module, a strobe light module and a horn module and;

a plurality of covers wherein each of the covers has a front wall and a peripheral skirt adapted to be positioned adjacent to a selected surface at which the respective cover is mountable, wherein each of the front walls of the members of the plurality includes an indented base regions which exhibits at least one common base-defining dimensional parameter for carrying any one of said output devices, wherein the covers each define an alarm signal-receiving region at least partially bounded by the peripheral skirt and wherein the covers each define an alarm signal output port from which an alarm signal in the respective receiving region exits the cover and radiates into an adjacent exterior region.

7. A system as in claim 6 which includes a plurality of output device mounting fixtures wherein the fixtures are adapted to be positioned adjacent to a part of a selected surface and wherein the covers are removably coupled to respective ones of the mounting fixtures thereupon covering the respective fixture and positioning the respective base regions adjacent to respective ones of the parts of the selected surfaces with a common footprint defined by the common base-defining dimensional parameter.

8. A system as in claim 7, wherein the footprint is circular and the common base-defining parameter is a common diameter thereof.

9. A system as in claim 6, which includes a communications link and a control element, said communications link coupled between the control element and the output devices.

10. A system as in claim 9, wherein the link comprises an elongated cable.

11. A modular alarm system, comprising:

a plurality of covers, each cover including an annular skirt and a circular front wall, the skirt depending from the front wall, the front wall having an indented circular base region; and a plurality of alarm modules each having a circular module wall sized to nest closely within said indented base region, the plurality of alarm modules including at least two different members of a group which includes an audible alarm generator, a visible alarm generator, and a combined audible/visible alarm generator.

12. A system as in claim 11, further comprising an adaptor plate mounted to said cover and arranged on said indented region and providing fastener-receiving barrels, and said module wall includes fastener holes in registry with said fastener-receiving barrels, and fasteners inserted into said fastener holes are engaged in said fastener-receiving barrels for holding said module wall onto said indented region.

13. A system as in claim 12 further comprising a junction box beneath said cover and wherein said adaptor plate includes fastener mounting holes wherein a plurality of fasteners passing through said fastener mounting holes and through said cover engage fastener-engaging holes of said junction box.

14. A modular alarm system, comprising:

a plurality of covers, each cover including a front wall, and a skirt depending from the front wall, the front wall having an indented base region, the skirt having a free edge, the skirt having a depth to receive therein a surface-mounted junction box;

a plurality of adaptor plates, each of said adaptor plates sized to overlie a portion of said front wall within said base region, said adaptor plates having fastener holes aligned with at least two fastener receiving lugs of said surface mounted junction box, said adaptor plates each having at least one fastener-receiving barrel; and a plurality of alarm modules each having a module wall sized to nest closely within said indented base region, and each having a fastener hole aligned with said fastener-receiving barrel when said module wall is nested within said indented base region.

15. A system according to claim 14, wherein said plurality of alarm modules includes at least two different members of a group which includes an audible alarm generator, a visible alarm generator, and a combined audible/visible alarm generator.

16. A system according to claim 14, wherein said adaptor plate includes two fastener-receiving barrels, and the alarm devices include corresponding two fastener holes aligned with said two fastener-receiving barrels, a center point between said two fastener-receiving barrels being eccentrically located with respect to a center point of said surface-mounted junction box.

* * * * *